US007701473B2

(12) United States Patent
Yi

(10) Patent No.: US 7,701,473 B2
(45) Date of Patent: Apr. 20, 2010

(54) METHOD AND APPARATUS FOR GAMMA CORRECTION AND FLAT-PANEL DISPLAY USING THE SAME

(75) Inventor: Chien-Yu Yi, Tao Yuan Shien (TW)

(73) Assignee: AU Optronics Corp., Hsinchu (TW)

( * ) Notice: Subject to any disclaimer, the term of this patent is extended or adjusted under 35 U.S.C. 154(b) by 1327 days.

(21) Appl. No.: 10/918,976

(22) Filed: Aug. 16, 2004

(65) Prior Publication Data

US 2005/0219273 A1 Oct. 6, 2005

(30) Foreign Application Priority Data

Mar. 30, 2004 (TW) ..... 93108642 A

(51) Int. Cl.
*G09G 5/10* (2006.01)

(52) U.S. Cl. ..... 345/690; 345/101

(58) Field of Classification Search ..... 345/690, 345/87, 88, 94, 98, 101
See application file for complete search history.

(56) References Cited

U.S. PATENT DOCUMENTS 6,271,821 B1 * 8/2001 Sung et al. ..... 345/98
6,765,551 B2 * 7/2004 Nakano et al. ..... 345/89
6,844,881 B1 * 1/2005 Chen et al. ..... 345/589
7,119,760 B2 * 10/2006 Edge et al. ..... 345/2.1
2002/0167473 A1 * 11/2002 Johnson et al. ..... 345/76
2005/0041003 A1 * 2/2005 Yamada ..... 345/77
2005/0062691 A1 * 3/2005 Tamura et al. ..... 345/76

FOREIGN PATENT DOCUMENTS

CN 1432988 7/2003
JP 2000163019 6/2000

OTHER PUBLICATIONS

CN Office Action mailed Feb. 16, 2007.

* cited by examiner

*Primary Examiner*—Chanh Nguyen
*Assistant Examiner*—Calvin C Ma
(74) *Attorney, Agent, or Firm*—Thomas, Kayden, Horstemeyer & Risley

(57) ABSTRACT

A method and apparatus for gamma correction and a flat panel display using the same. Weighted values corresponding to red, green and blue of an image signal are respectively evaluated to determine the dominant color in the image signal, and a Gamma correction based on the dominant color is then performed, thereby obtaining displaying quality similar with that obtained by independently performing red, green, or blue Gamma correction.

12 Claims, 5 Drawing Sheets

METHOD AND APPARATUS FOR GAMMA CORRECTION AND FLAT-PANEL DISPLAY USING THE SAME

BACKGROUND

The invention relates to a method and apparatus for Gamma correction, and more particularly, to a Gamma correction method and apparatus for use in a flat panel display.

Gamma correction is widely adopted to function for improving image display quality in flat panel displays. Conventional source driver circuits in a flat panel display, however, comprise only a resistor string for generating reference voltage, thus Gamma can not be individually corrected for red, green and blue. Therefore a room temperature gray level gamma curve is taken as the basis for the Gamma correction voltage.

FIG. 1 shows gray level, red, green and blue Gamma curves at room temperature, wherein "W" indicates the gray level. Obviously the Gamma curve varies by color, thus the display quality of the flat panel display may be diminished due to color distortion when the gray level Gamma curve is the only basis for Gamma correction.

SUMMARY

Embodiments of the invention therefore provide a method and apparatus for Gamma correction. The weighted values corresponding to red, green and blue of an image signal are respectively evaluated to determine the dominant color in the image signal, and a Gamma correction based on the dominant color is then performed; thereby obtaining display quality similar to that obtained by Gamma correction individually performed for red, green, or blue.

An embodiment of the invention provides a Gamma correction method for use in a flat panel display. First, weighted values of a first color, a second color and a third color in an image signal are obtained, and a dominant color is determined accordingly. Thereafter, a reference voltage corresponding to the dominant color is determined for performing the Gamma correction for the flat panel display.

The step of determining the reference voltage comprises the following steps. First, reference voltage tables of the first, second and third colors are provided, and one of the reference voltage tables is selected according to the dominant color. Thereafter, the value of reference voltage is looked up in the selected reference voltage table.

The step of determining the reference voltage alternatively comprises the following steps. First, a memory unit for storing configurations of the first, the second and the third colors is provided. A programmable reference voltage table generator is provided, and the configuration corresponding to the dominant color is obtained from the memory unit. Thereafter, the configuration of the dominant color is input to the programmable reference voltage table generator to generate the reference voltage.

Another embodiment of the invention provides a Gamma correction device for use in a flat panel display. The Gamma correction device comprises a capture unit, a first color reference voltage table, a second color reference voltage table, a third color reference voltage table, and a selector. The capture unit receives an image signal and obtains weighted values of a first color, second color and third color therein. The selector, coupled to the first, second and third color reference voltage tables, selects one table and outputs a reference voltage corresponding thereto.

Another embodiment of the invention provides a Gamma correction device for use in a flat panel display. The Gamma correction device comprises a capture unit, a memory unit, a programmable reference voltage table generator. The capture unit receives an image signal and obtains weighted values of a first color, a second color and a third color therein. The memory unit stores configurations of the first, the second and the third colors, and is capable of determining a dominant color according to the weighted values, and outputting the configuration of the dominant color. The programmable reference voltage table generator for receiving the configuration of the dominant color generates corresponding reference voltage.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

A detailed description of embodiments of the invention is provided in the following.

Figure 1:
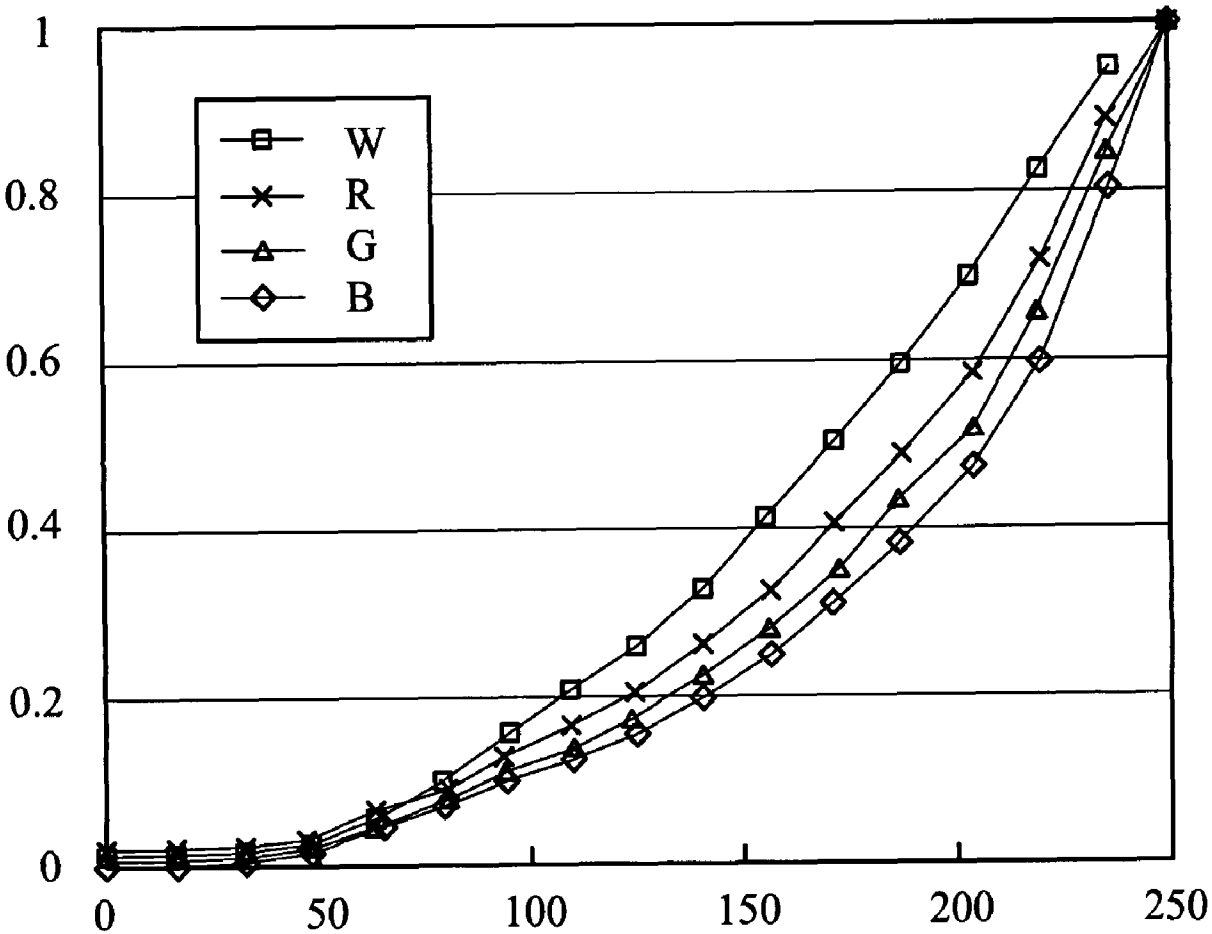
FIG. 1 shows gray level, red, green and blue Gamma curves at room temperature.
Figure 2:
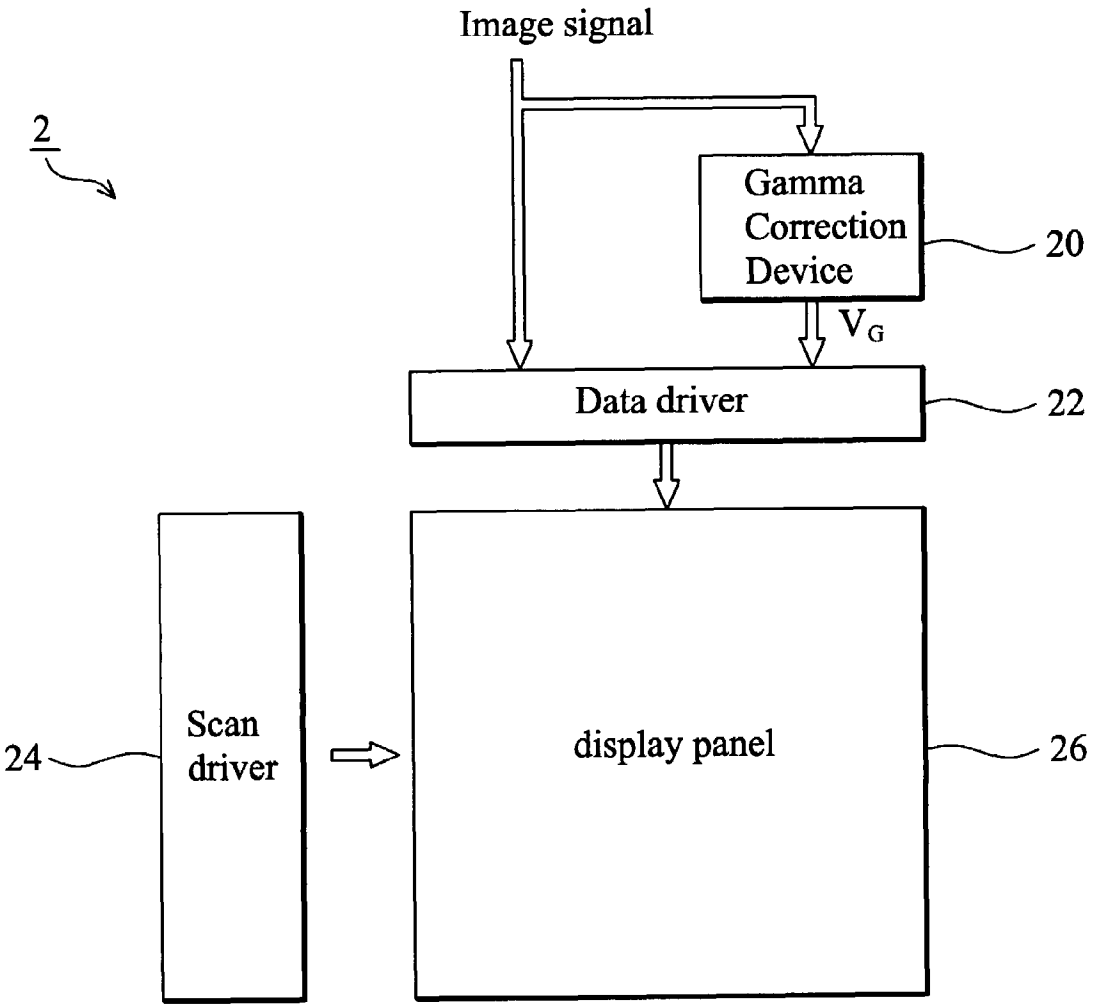
FIG. 2 is a block diagram of a flat panel display according to an embodiment of the invention.

FIG. 2 is a block diagram of a flat panel display according to an embodiment of the invention. The flat panel display 2 comprises a gamma correction device 20, a data driver 22, a scan driver 24 and a display panel 26. The Gamma correction device 20 first determines a dominant color that has the greatest weight among the three primary colors, and then outputs corresponding Gamma correction voltage $V_G$ to the data driver 22. The data driver 22 receives the image signal and the Gamma correction voltage $V_G$, and the display panel 26 is driven by the data driver 22 and scan driver 24. The flat panel display 2 can be a liquid crystal display, or any flat panel display capable of applying Gamma correction.

First Embodiment

The first embodiment of the invention provides a Gamma correction method for a flat panel display. First, image signal is analyzed to evaluate weighted values of red, green and blue. Based on the weighted values, a dominant color can then be determined. A reference voltage corresponding to the dominant color can then be determined for Gamma correction.

The process of determining the reference voltage corresponding to the dominant color comprises the following steps. First, red, green and blue reference voltage tables are provided. One of the tables is then selected according to the dominant color, for lookup of the reference voltage.

Figure 3:
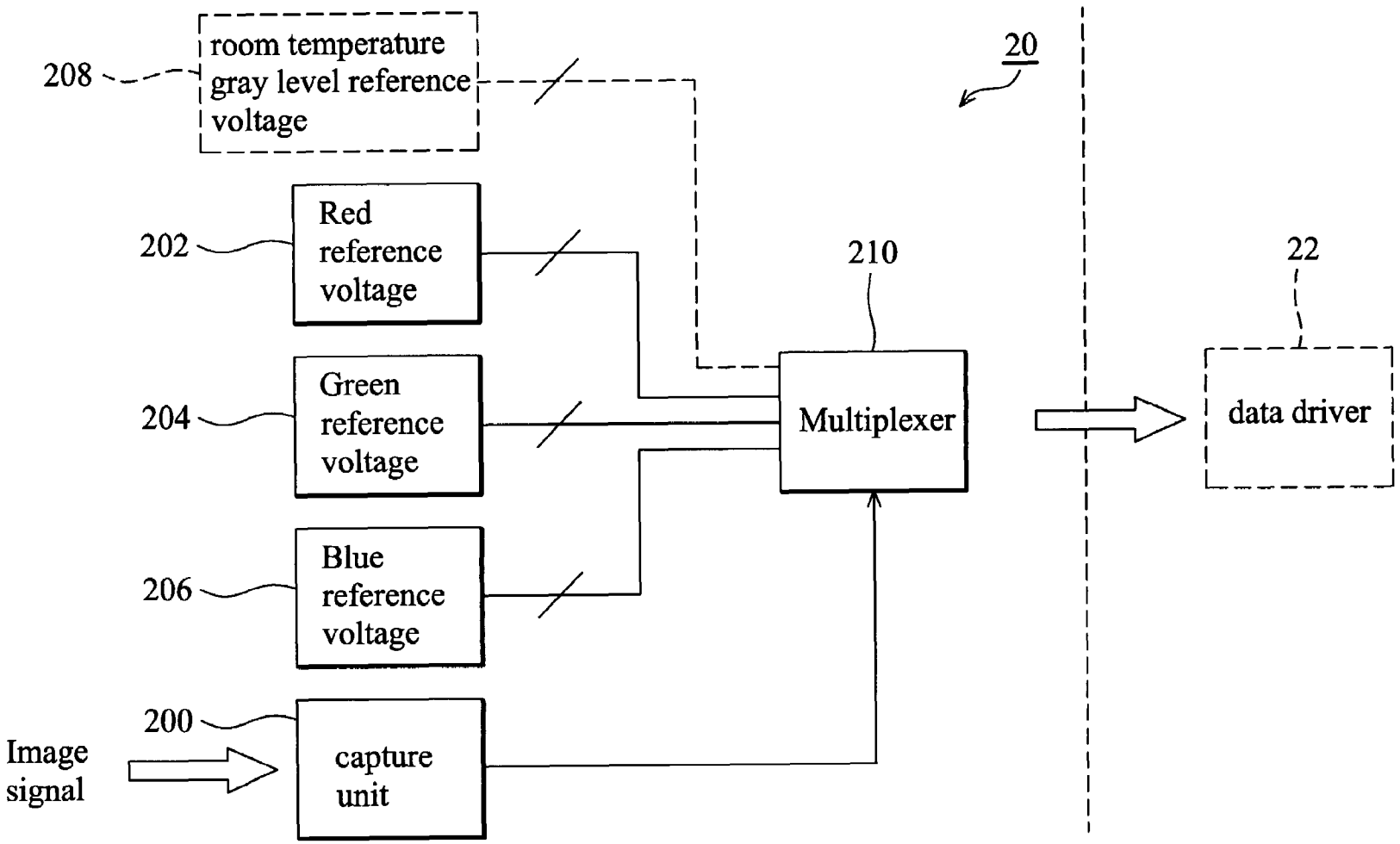
FIG. 3 is block diagram of a gamma correction device according to an embodiment of the invention.

FIG. 3 is block diagram of a gamma correction device according to this embodiment. The Gamma correction device 20 comprises a capture unit 200, a red reference voltage table 202, a green reference voltage table 204, a blue reference voltage table 206 and a selector 210. The capture unit 200 receives an image signal and evaluates weighted values of the red, green and blue colors in the image signal. The selector 210 coupled to the red reference voltage table 202, green reference voltage table 204 and blue reference voltage table 206, selects one table according to the weighted values for output of a reference voltage.

The selector 210, for example, can be a multiplexer. If in the image signal, the red color has the greatest weighted value among the three primary colors, the multiplexer outputs the reference voltage looked up in the red reference voltage table 202, to drive the data driver 22.

Additionally, a gray level reference voltage table 208 can be provided at room temperature. If the weighted values of red, green and blue colors are substantially even, the multiplexer can choose the reference voltage looked up in the gray level reference voltage table 208 for output.

Second Embodiment

Alternatively, another embodiment of a method for determining the reference voltage corresponding to the dominant color is provided.

First a memory unit is provided, storing at least three configuration sets of red, green and blue and a programmable reference voltage table generator is also provided. According to the dominant color, a corresponding configuration of the dominant color is then obtained from the memory unit. Thereafter, the configuration of the dominant color is input to the programmable reference voltage table generator for generating the reference voltage.

Figure 4:
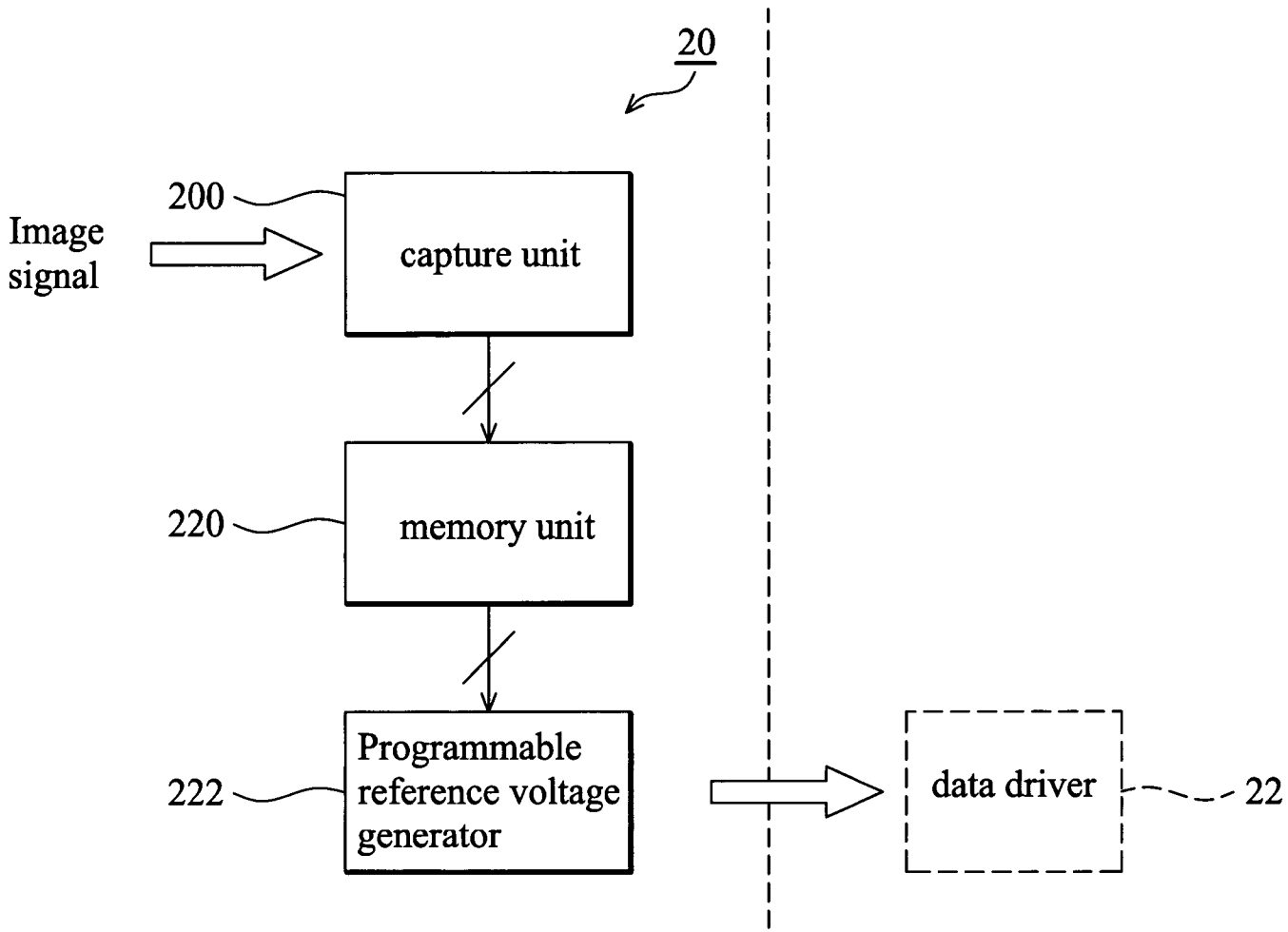
FIG. 4 is block diagram of a gamma correction device according to an embodiment of the invention.

FIG. 4 shows the Gamma correction device 20 according to this embodiment of the invention. The Gamma correction device 20 comprises a capture unit 200, a memory unit 220 and a programmable reference voltage generator 222. The capture unit 200 receives an image signal and evaluates the weighted values of red, green and blue colors therein. The memory unit 220 stores at least three configuration sets corresponding to red, blue, and green, one of which is chosen for output as the configuration of the dominant color based on the weighted values. The programmable reference voltage generator 222 receives the configuration of the dominant color, and accordingly generates the reference voltage.

In this embodiment, the memory unit 220 can be an EEPROM, and the stored configurations can be red reference voltage table 202, green reference voltage table 204, blue reference voltage table 206 and gray level reference voltage table 208. The weighted values of the red, green and blue colors are taken as a basis for choosing a corresponding reference voltage table.

The programmable reference voltage generator 222, for example, can be a programmable Gamma buffer for receiving the reference voltage table corresponding to the dominant color, and generating the reference voltage corresponding to the dominant color.

If the red color has the greatest weighted value in the image signal, the capture unit 200 outputs corresponding control signal (or addressing signal), and the red reference voltage table 202 is then obtained from memory unit 220. The programmable Gamma buffer analogizes a digital voltage in the red reference voltage table 202 to obtain a red reference voltage, for driving the 22.

Third Embodiment

Figure 5:
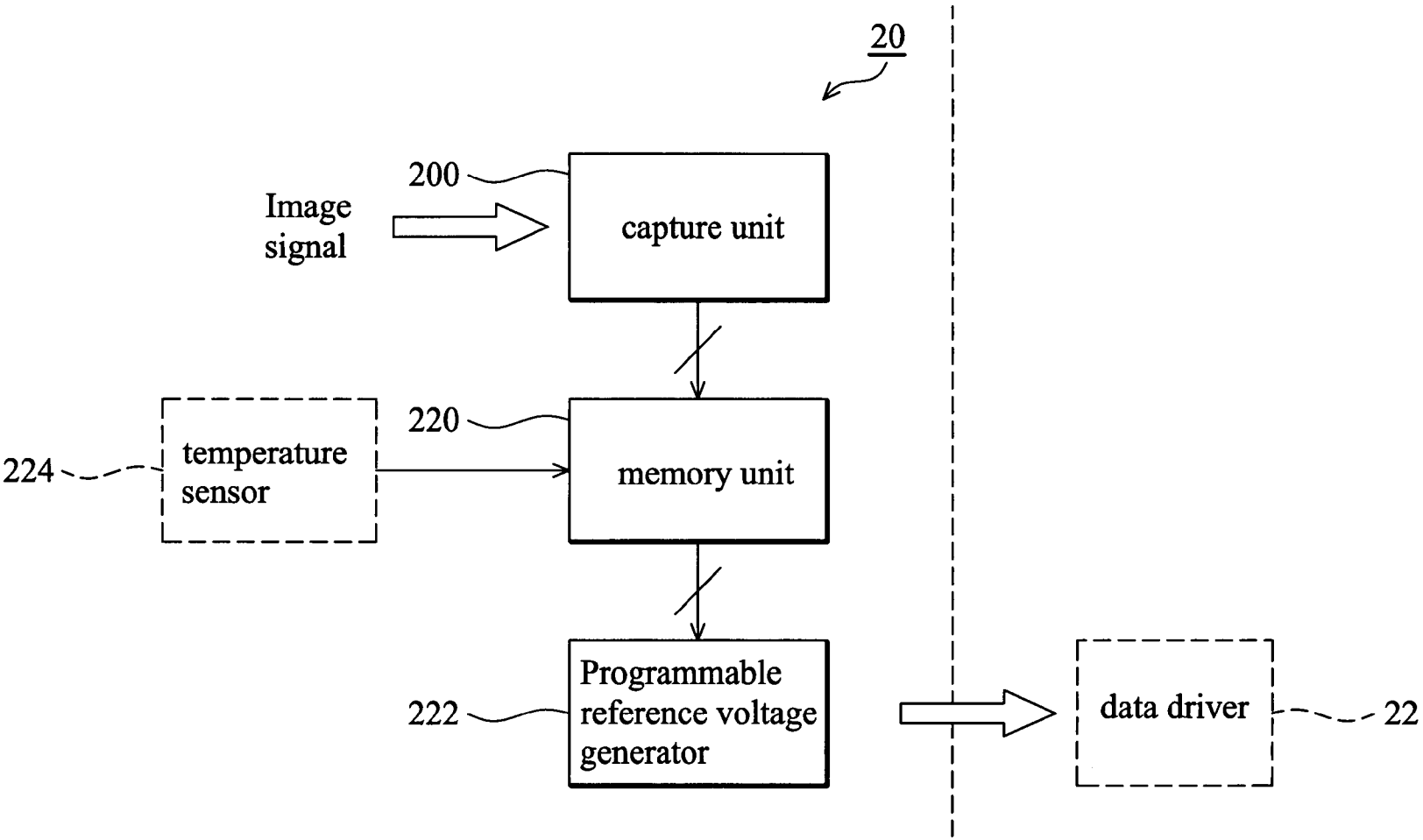
FIG. 5 is block diagram of a gamma correction device according to an embodiment of the invention.

Flat panel displays, such as liquid crystal displays, typically employ multi-tube backlight modules, thus generating relatively high environmental temperature. In order to compensate for the Gamma curve shift due to environmental temperature variation, a temperature sensor 224 can be added to the flat panel display or the Gamma correction device, as shown in FIG. 5.

The memory unit 220 obtains the configuration of the dominant color based on the weighted values and the temperature detection result provided by the temperature sensor 224.

In this embodiment, the memory unit 220 stores three sets of red reference voltage tables 202 R1 to R3, three sets of green reference voltage tables 204 G1 to G3, and three sets of blue reference voltage tables 206 B1 to B3, each corresponding to a different environmental temperature range.

If red in the image signal has the greatest weighted value, the red reference voltage tables 202 R1 to R3 in the memory unit 220 are chosen first. The temperature sensor 224 chooses the most appropriate reference voltage tables from the R1 to R3 by detecting environmental temperature.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A Gamma correction method for a flat panel display comprising a data driver that Gamma cannot be individually corrected for red, green and blue, comprising the following steps:

obtaining weighted values of a first color, a second color and a third color in an image signal;

determining a dominant color for use in Gamma correction according to the weighted values, wherein the dominant color is selected from the first, second or third color; and determining a reference voltage corresponding to the dominant color and applying the reference voltage to the data driver to generate a gamma curve corresponding to the dominant color; and displaying the first, second and third colors on the flat panel display using the gamma curve.

2. The Gamma correction method as claimed in claim 1, wherein the step of determining the reference voltage comprises the following steps:

providing reference voltage tables of the first, the second and the third colors;

selecting one of the reference voltage tables according to the dominant color; and looking up the value of the reference voltage in the selected reference voltage table.

3. The Gamma correction method as claimed in claim 1, wherein the step of determining the reference voltage comprises the following steps:

providing a memory unit for storing configurations of the first, the second and the third colors;

providing a programmable reference voltage table generator;

obtaining the configuration corresponding to the dominant color from the memory unit; and inputting the configuration of the dominant color to the programmable reference voltage table generator to generate the reference voltage.

4. The Gamma correction method as claimed in claim 3, further comprising detecting temperature of the flat panel display, and obtaining the configuration of the dominant color from the memory unit according to the dominant color and the detected temperature.

5. The Gamma correction method as claimed in claim 1, wherein the first, second and third colors are red, green and blue.

6. The Gamma correction method as claimed in claim 1, wherein of the first, second and third colors, the color with the greatest weighted value is assigned as the dominant color.

7. A Gamma correction device for use in a flat panel display comprising a data driver that Gamma cannot be individually corrected for red, green and blue, comprising:

a capture unit, for receiving an image signal and obtaining weighted values of a first color, second color and third color therein;

a first color reference voltage table;

a second color reference voltage table;

a third color reference voltage table; and a selector coupled to the first, second and third color reference voltage tables, for selecting one table and outputting a reference voltage corresponding to the selected table to the data driver, such that the data driver generates a gamma curve corresponding to the reference voltage to display the first, second and third colors.

8. The Gamma correction device as claimed in claim 7, wherein the selector is a multiplexer.

9. The Gamma correction device as claimed in claim 7, wherein the selector chooses from the first, second and third colors the color with the greatest weighted value as a dominant color.

10. A flat panel display, comprising:

a display panel;

a capture unit, for receiving an image signal and obtaining weighted values of a first color, a second color and a third color therein;

a first color reference voltage table;

a second color reference voltage table;

a third color reference voltage table;

a selector, coupled to the first, second and third color reference voltage tables, for selecting one table and outputting a reference voltage corresponding thereto; and a source driver, receiving the reference voltage and the image signal, generating a gamma curve based on the reference voltage, and driving the display panel to display the first, second and third colors using the gamma curve.

11. The flat panel display as claimed in claim 10, wherein the selector is a multiplexer.

12. The flat panel display as claimed in claim 10, wherein the selector chooses from the first, second and third colors the color with the greatest weighted value as a dominant color.

* * * * *